US007097374B2

(12) United States Patent
Sugiura et al.

(10) Patent No.: US 7,097,374 B2
(45) Date of Patent: Aug. 29, 2006

(54) IMAGE FORMING APPARATUS AND SHEET FEED TABLE FOR USE IN THE APPARATUS

(75) Inventors: Toshio Sugiura, Anjo (JP); Tetsuo Asada, Kuwana (JP); Nobuo Hiraki, Nagoya (JP); Kan Ishikawa, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/803,142

(22) Filed: Mar. 18, 2004

(65) Prior Publication Data

US 2004/0189777 A1 Sep. 30, 2004

(30) Foreign Application Priority Data

Mar. 31, 2003 (JP) ..... 2003-096021

(51) Int. Cl.
*B41J 2/185* (2006.01)
*B41J 2/01* (2006.01)
*B41J 11/08* (2006.01)

(52) U.S. Cl. ..... 400/656; 347/89; 347/90

(58) Field of Classification Search ..... 347/34, 347/35, 36

See application file for complete search history.

(56) References Cited

U.S. PATENT DOCUMENTS

| | | | | |
|---|---|---|---|---|
| 5,997,129 | A * | 12/1999 | Matsuhashi | 347/35 |
| 6,239,817 | B1 | 5/2001 | Meyer | |
| 2005/0078147 | A1* | 4/2005 | Kodama et al. | 347/36 |
| 2005/0225621 | A1* | 10/2005 | Ishii et al. | 347/102 |

FOREIGN PATENT DOCUMENTS

| | | | |
|---|---|---|---|
| JP | 01275090 A | * | 11/1989 |
| JP | A 2-286340 | | 11/1990 |
| JP | A-5-69606 | | 3/1993 |
| JP | 05286129 A | * | 11/1993 |
| JP | A-2000-118058 | | 4/2000 |
| JP | A 2001-30481 | | 2/2001 |
| JP | A-2001-88375 | | 4/2001 |
| JP | A 2001-105583 | | 4/2001 |
| JP | 2001347691 A | * | 12/2001 |
| JP | A 2001-347651 | | 12/2001 |
| JP | A-2001-347692 | | 12/2001 |

(Continued)

OTHER PUBLICATIONS

Machine translation of JP 2003-39758 to Seshimo from Japanese Patent Office website.*

(Continued)

*Primary Examiner*—Daniel J. Colilla
(74) *Attorney, Agent, or Firm*—Oliff & Berridge, PLC

(57) ABSTRACT

A sheet feed table has a plurality of ribs formed on a surface thereof. The ribs extend in a sheet feeding direction and are disposed at a predetermined interval in a direction perpendicular to the sheet feeding direction. An air duct is provided between the adjacent ribs. An ink passage opening is formed in an image forming region where a print head moves to form an image. Disposed below the ink passage opening is an ink receiving chamber in which an ink absorber is disposed. A suction opening that communicates with the air duct is disposed upstream and downstream of the image forming region in the sheet feeding direction. A suction device is connected such that the air is sucked through the suction openings into a negative pressure chamber provided on an underside of the sheet feed table. The negative pressure chamber and the ink receiving chamber are separated from each other.

25 Claims, 12 Drawing Sheets

FOREIGN PATENT DOCUMENTS

| | | | |
|---|---|---|---|
| JP | A-2002-86821 | | 3/2002 |
| JP | 2002144650 A | * | 5/2002 |
| JP | A-2002-192756 | | 7/2002 |
| JP | 2002361904 A | * | 12/2002 |
| JP | 2003039758 A | * | 2/2003 |
| JP | A-2003-34057 | | 2/2003 |
| JP | A-2003-72111 | | 3/2003 |

OTHER PUBLICATIONS

Machine translation of JP 2001-347691 to Tsutumi et al. from Japanese Patent Office website.*

Machine translation of JP 2002-144650 to Konuki from Japanese Patent Office website.*

* cited by examiner

IMAGE FORMING APPARATUS AND SHEET FEED TABLE FOR USE IN THE APPARATUS

BACKGROUND OF THE INVENTION

1. Field of Invention

The invention relates to an images forming apparatus including an image forming device that ejects ink onto a sheet and a suction-type sheet feed table.

2. Description of Related Art

There exists a serial image forming apparatus that includes an inkjet print head that ejects ink from nozzles thereof onto a sheet in order to form an image on the sheet. The image forming apparatus includes a sheet feed table, such as a platen, that is disposed to face a nozzle surface of the print head. A pair of sheet feeding rollers are disposed upstream and downstream of the sheet feed table in a sheet feeding direction, across the sheet feed table. By driving the upstream and downstream sheet feeding rollers intermittently, the sheet held between the upstream and downstream sheet feeding rollers are fed intermittently little by little or stepwise in the sheet feeding direction (sub scanning direction). This feeding manner is referred to as "step feeding". Although the sheet is not fed in the sub scanning direction during the intermittent sheet feeding, the print head mounted on a carriage ejects ink, while the carriage is moved in a main scanning direction, onto a sheet supported by the sheet feed table in order to form an image on the sheet by a predetermined area or zone at a time.

As the ink ejected from the print head is attached to the sheet held between the downstream and upstream sheet feeding rollers, the sheet absorbs the moisture, resulting in cockling or an uneven, wavy surface. The uneven, wavy surface of the sheet due to the cockling may cause the surface of the sheet to contact the nozzle surface, leading to a smudged image on the sheet and resulting in a deteriorated image quality. In addition, if the sheet is curled up, especially at a leading end of the sheet before being held by the downstream sheet feeding rollers or at a trailing end of the sheet that has passed through the upstream sheet feeding rollers, the curled leading end or the trailing end of the sheet may contact and slide over the nozzle surface, causing the smudges on the sheet or damage on the print head.

To prevent such situations, an inkjet recording apparatus, as disclosed in Japanese Laid-Open Patent Publication No. 2-286340, includes an air suctioning device and a sheet feed table that communicates with the air suctioning device and is provided on a surface thereof with a plurality of small air intake holes.

SUMMARY OF THE INVENTION

In an inkjet image forming apparatus, ink ejection failure from the nozzles may be caused by air bubbles or dust included in the print head or ink dried in the print head. To prevent the ink ejection failure, there exists an inkjet image forming apparatus with a maintenance unit, as an ink receiver, at an end of the apparatus in the carriage moving direction outside the sheet feed table. To clear nozzles that are clogging, the image forming apparatus performs a flushing operation by ejecting a predetermined amount of ink from the nozzles after the carriage is moved to a position where the nozzle surface of the print head faces the ink receiver. If this type of ink receiver is applied to the image forming apparatus disclosed in, for example, Japanese Laid-Open Patent Publication No. 2-286340, the print head and the carriage have to be moved, in the main scanning direction (sheet width direction) perpendicular to the sheet feeding direction, to the end where the ink receiver is disposed. With this structure, the carriage has to be moved further outside the sheet feed table, regardless of the sizes of the sheets to be used for printing, resulting in inefficient printing operations due to the long moving distance of the carriage in the width direction of the image forming apparatus.

In an image forming apparatus that suctions or vacuums a sheet during a printing operation, a current of air is created in the image forming apparatus due to the suctioning or vacuuming. Consequently, the nozzles of the print head become easier to dry, as compared with an image forming apparatus that does not employ the sheet suctioning or vacuuming system. To prevent the nozzles from being dried, intervals between the flushing operations need to be shortened resulting in inefficient printing operation.

Accordingly, one exemplary aspect of the invention is to provide an image forming apparatus that performs an efficient printing operation by reducing the operations of a print head associated with a maintenance operation that are no longer deemed to be necessary.

An image forming apparatus according to the invention that forms an image on a sheet by ejecting ink may include a sheet feed table that is disposed to face an ink ejection direction of the image forming device and has a surface region at an upper side thereof for supporting the sheet, a sheet feeding mechanism that feeds the sheet in a sheet feeding direction, at least one air suctioning portion that is formed on the surface region of the sheet feed table at an upstream or a downstream side of an image forming region, wherein when the image forming device forms the image, the air suctioning portion allows air to be sucked therethrough, an air suctioning device that sucks air through the air suctioning portion, and an ink receiver that receives ink ejected from the image forming device and is disposed in a portion of the image forming region.

In the image forming apparatus according to the invention, the air suctioning portion may be formed upstream and/or downstream of the image forming region, so that the sheet may be sucked during a printing operation while preventing the sheet moistened with ink from contacting a lower surface of the image forming device.

A flushing operation may be conducted at a part of the image forming region not only before the start of printing but also in the middle of a printing operation on a plurality of the sheets. Therefore, a printing operation may be performed more speedily, as compared with the case where the flushing operation is performed at a maintenance unit disposed outside the sheet feed table, because the moving distance of a carriage is reduced.

BRIEF DESCRIPTION OF THE DRAWINGS

Embodiments of the invention will be described in detail with reference to the following figures in which like elements are labeled with like reference numerals and in which.

DETAILED DESCRIPTION OF PREFERRED EMBODIMENTS

Embodiments of the invention will be described in detail with reference to the figures. An image forming apparatus according to an embodiment of the invention is, for example, a serial inkjet printer 1 having a print head 2.

Figure 1:
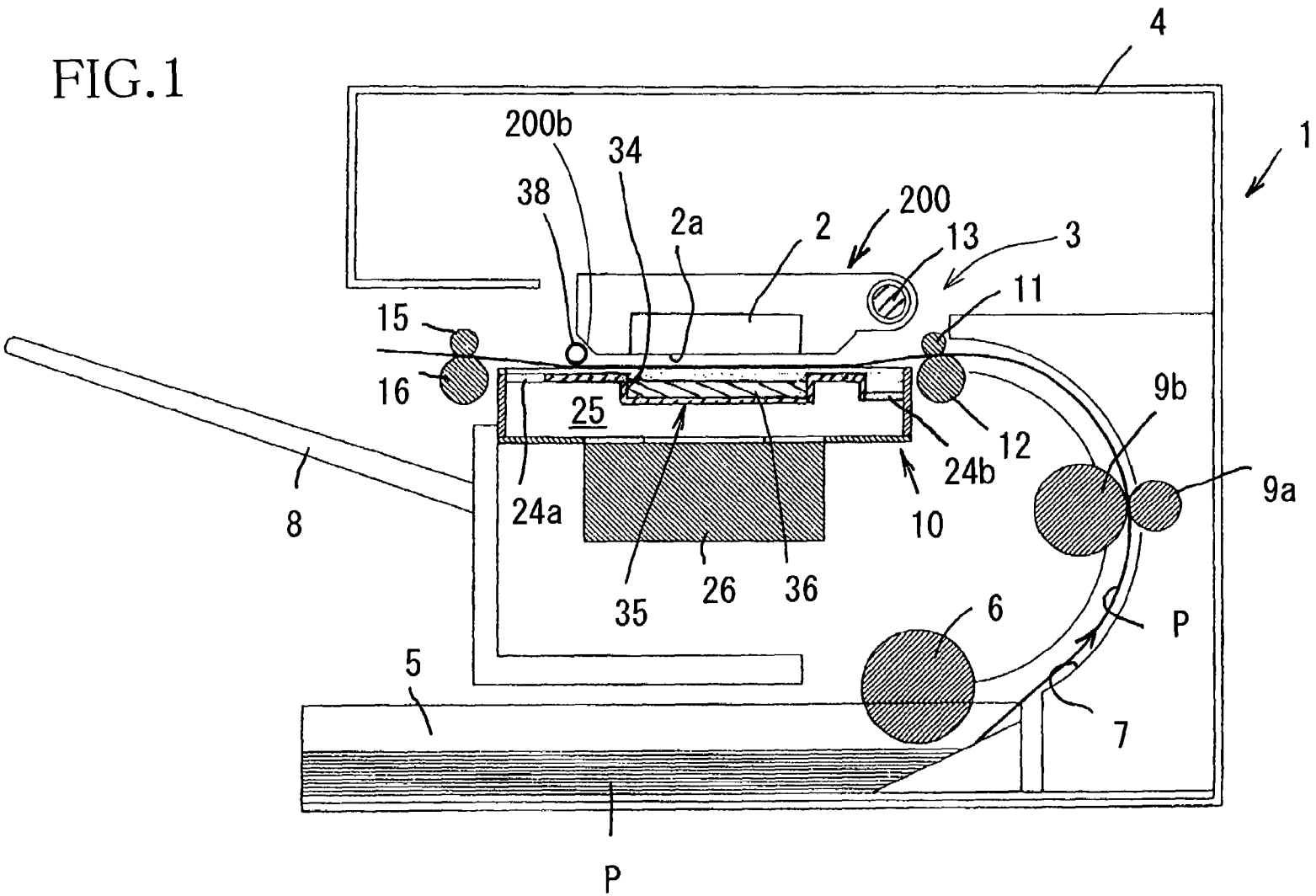
FIG. 1 is a side cross-sectional view of a printer according to the invention.

As shown in FIG. 1, the printer 1 includes a main case 4. Provided on a lower portion of the main case 4 is a sheet tray 5 that is removably set in the main case 4. Disposed in the sheet tray 5 is a sheet mounting plate (not shown) that is urged upwardly and mounts thereon a stack of sheets P. The topmost sheet P of the sheet stack on the sheet tray 5 is picked up by rotating a pick-up roller 6 disposed above leading ends of the sheets P. The sheet P picked up by the pick-up roller 6 is fed in a sheet feeding path 7, to a printing unit 3 through sheet conveying rollers 9*a*, 9*b*. An image is formed on the sheet P by the printing unit 3. The sheet having the image formed thereon is then fed to a discharge tray 8 that extends from a surface of the main case 4.

The printer 1 is capable of forming an image on sheets P of different sizes, by exchanging the sheet tray 5 or by adjusting a sheet guide provided on the sheet tray 5. The printer 1 also adopts a sheet feeding system that takes a center of a sheet in the width direction as a reference for feeding the sheets P for every sized sheet.

The printer 1 is provided on an upper portion of the main case 4 with a control panel (not shown) that includes numeric keys and buttons for executing various commands, such as printing operation, as well as a liquid crystal display for displaying necessary information.

The printing unit 3 includes a color inkjet print head 2, a suction or vacuum type sheet feed table 10, which will be described in more detail below, upstream sheet feeding rollers 11, 12 disposed upstream of the sheet feed table 10, and downstream sheet feeding rollers 15, 16 disposed downstream of the sheet feed table 10.

The print head 2 is mounted on a carriage 200 that reciprocates in a main scanning direction, along two guide shafts 13 (only one shaft 13 shown in FIG. 1). The print head 2 has a nozzle surface 2*a* on which a plurality of nozzles are formed at a certain distance therebetween in a sheet feeding direction forming nozzle rows for each ink color. The print head 2 is disposed such that the nozzle surface 2*a* faces an upper surface of the sheet feed table 10. Removably set on the carriage 200 are ink cartridges (not shown), each storing one of cyan, yellow, magenta, and black color ink, in association with one of the nozzle rows of the print head 2. The moving direction of the print head 2 is referred to as the main scanning direction. The direction perpendicular to the main scanning direction is referred to as the sub scanning direction or the sheet feeding direction.

The upstream sheet feeding roller is made up of a drive roller 12 disposed on a side which contacts a lower side of the sheet P where an image is not formed, and a driven roller 11 disposed on a side which contacts an upper surface of the sheet P where an image is formed.

The downstream sheet feeding roller is made up of a plurality of drive rollers 16 disposed on a side which contacts an underside of the sheet P where an image is not formed, and a plurality of driven rollers 15 disposed on a side which contacts an upper surface of the sheet P where an image is formed. The downstream driven rollers 15 is preferably a spur type that gives less effects on an formed image. The downstream driven rollers 15 is disposed in the main scanning direction with a predetermined distance between the rollers 15. The upstream and downstream drive rollers 12, 16 are driven in synchronization with each other to rotate intermittently in the same direction, with a line feed motor (not shown) and a drive force transmission gear mechanism (not shown).

Structures of the suction or vacuum type sheet feed table 10 according to a first embodiment of the invention will be described in detail below with reference to FIGS. 1 to 4. The sheet table 10 is of a substantially box shape in plan view, enclosed by a generally flat upper plate 20 as a top face that faces the nozzle surface 2*a* of the print head 2, a bottom plate 10*a* as a bottom face that is disposed opposite to the upper plate 20, and four side plates 10*b* that are connected to the upper plate 20 and the bottom plate 10*a*. An inner area defined by the upper plate 20, the bottom plate 10*a*, and the side plates 10*b* in the sheet feed table 10 is a negative pressure chamber 25, which will be described below.

Figure 2:
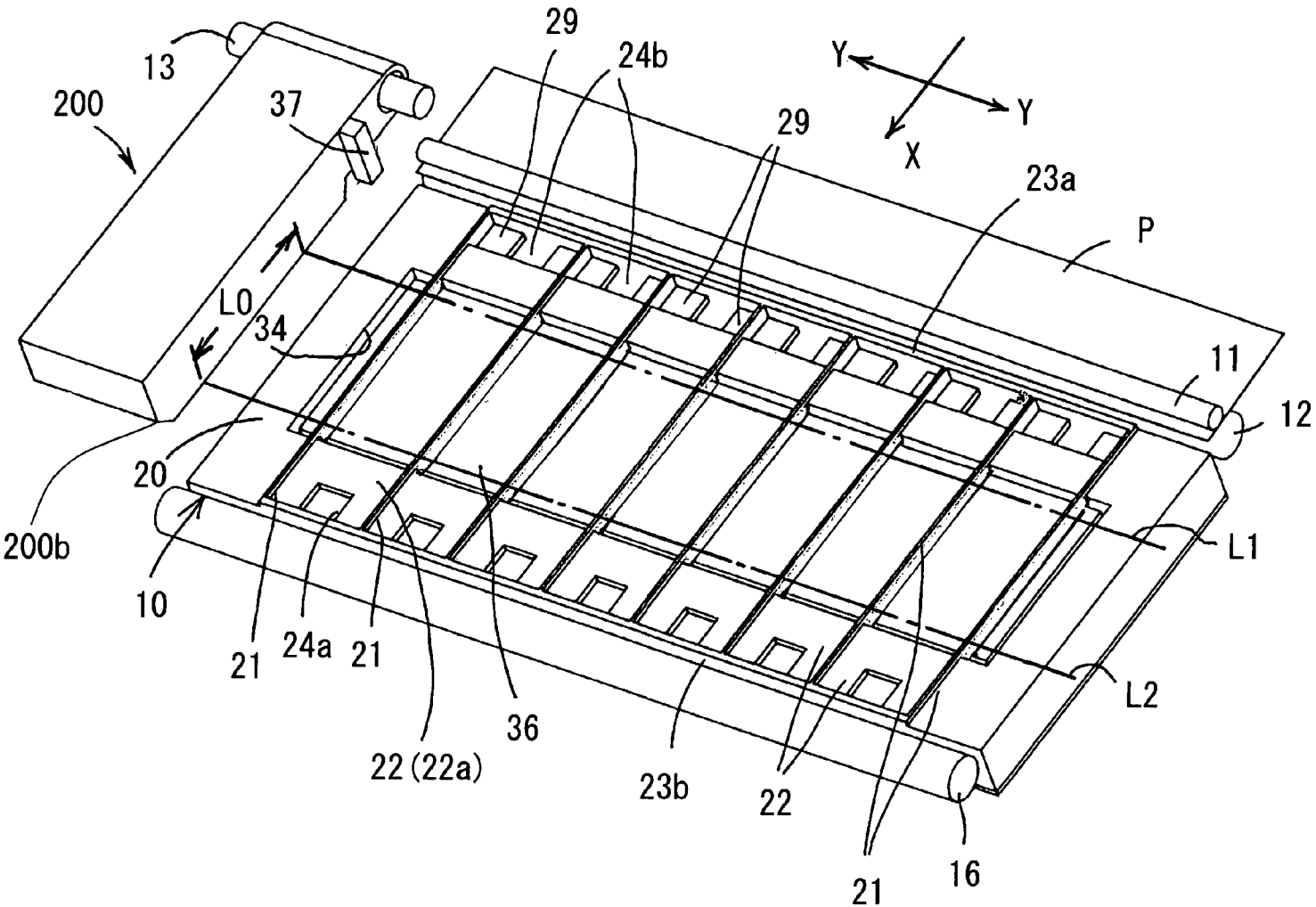
FIG. 2 is a perspective view of a sheet feed table according to the invention.

A plurality of ribs 21 that extend in the direction parallel to the sheet feeding direction (in the direction of the arrow X in FIG. 2) are disposed on an upper surface of the upper plate 20, with a predetermined distance therebetween in the direction perpendicular to the sheet feeding direction (in the direction of the arrow Y in FIG. 2). Each rib 21 functions as a supporting member that supports the rear or underside of the sheet P. Each rib 21 is formed long enough to extend across an image forming region from the upstream to the downstream sides of the image forming region. The image forming region is an area defined between L1 and L2 in FIGS. 2 and 3 indicated by alternate long and short dash lines. The distance between L1 and L2 corresponds to a length L0 of a nozzle row constituted by the plurality of the nozzles formed along the sheet feeding direction X with a certain distance therebetween. The image forming region is an area where the print head 2 can form an image while moving from one end to the other end in the main scanning direction Y.

The upper surface of the upper plate 20 is divided by the plurality of ribs 21 into a plurality of parts. As a result, an air duct 22 that extends in the sheet feeding direction X is formed between the adjacent ribs 21.

An ink passage opening 34, as an inlet to an ink receiver, receives the ink ejected from nozzles of the print head 2 during a flushing operation, which will be described in detail below. The ink passage opening 34 is also formed in the image forming region. The ink passage opening 34 is of a substantially rectangular shape in plan view. In the sheet feed table 10 shown in FIGS. 2–4 according to the first embodiment, a plurality of the ink passage openings 34 are continuously aligned in a row in the direction Y The total length of the row of ink passage openings 34 in the direction Y is longer than the width of a maximum sized sheet P that the printer 1 can handle. The plurality of the ribs 21 are provided, like bridges, across the upper portion of the row of ink passage openings 34. In other words, the row of the ink passage openings 34 is disposed to cross the air ducts 22 in plan view.

Figure 4:
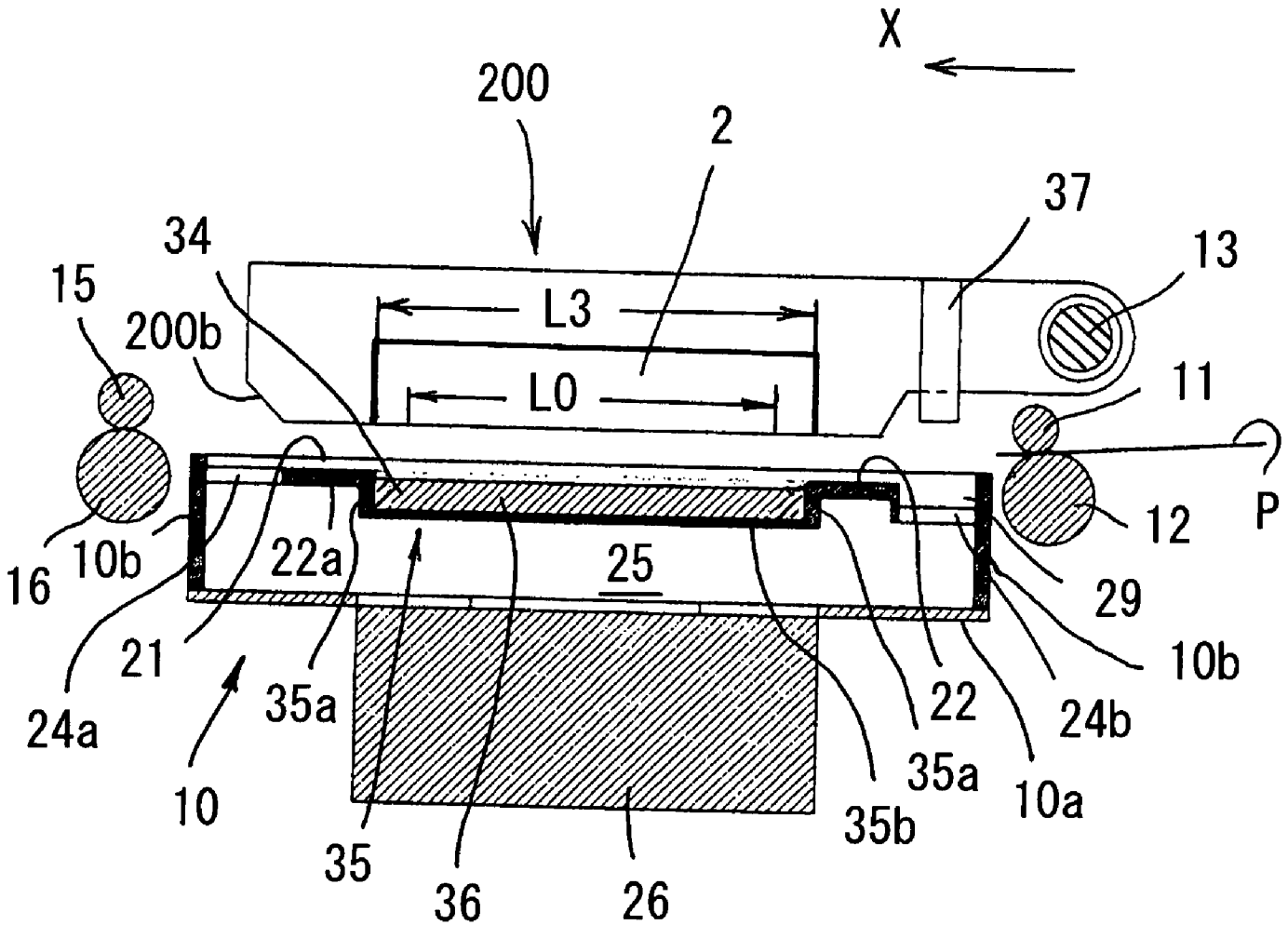
FIG. 4 is a cross-sectional view of the sheet feed table, taken along IV—IV in FIG. 3.

Disposed on an underside of the upper plate 20 is an upwardly open ink receiving chamber 35 that is formed with four side plates 35*a*, enclosing the periphery of the row of the ink passage openings 34, and a bottom plate 35*b* connected to the four side plates 35*a*, as shown in FIG. 4. The ink receiving chamber 35 may be connected to or integrally formed with the upper plate 20. Disposed in the ink receiving chamber 35 is an ink absorber 36 that prevents the ink ejected from the nozzles of the print head 2 from leaking out. The ink absorber 36 is formed of, for example, spongy or porous material, into a substantially flat shape. In the first embodiment, the ink absorber 36 is disposed in the ink receiving chamber 35 to extend in the direction Y below the ribs 21. The rib 21 extends downward to contact an upper surface of the ink absorber 36 while entering the ink passage opening 34 and the ink receiving chamber 35, as shown in FIG. 4.

Figure 3:
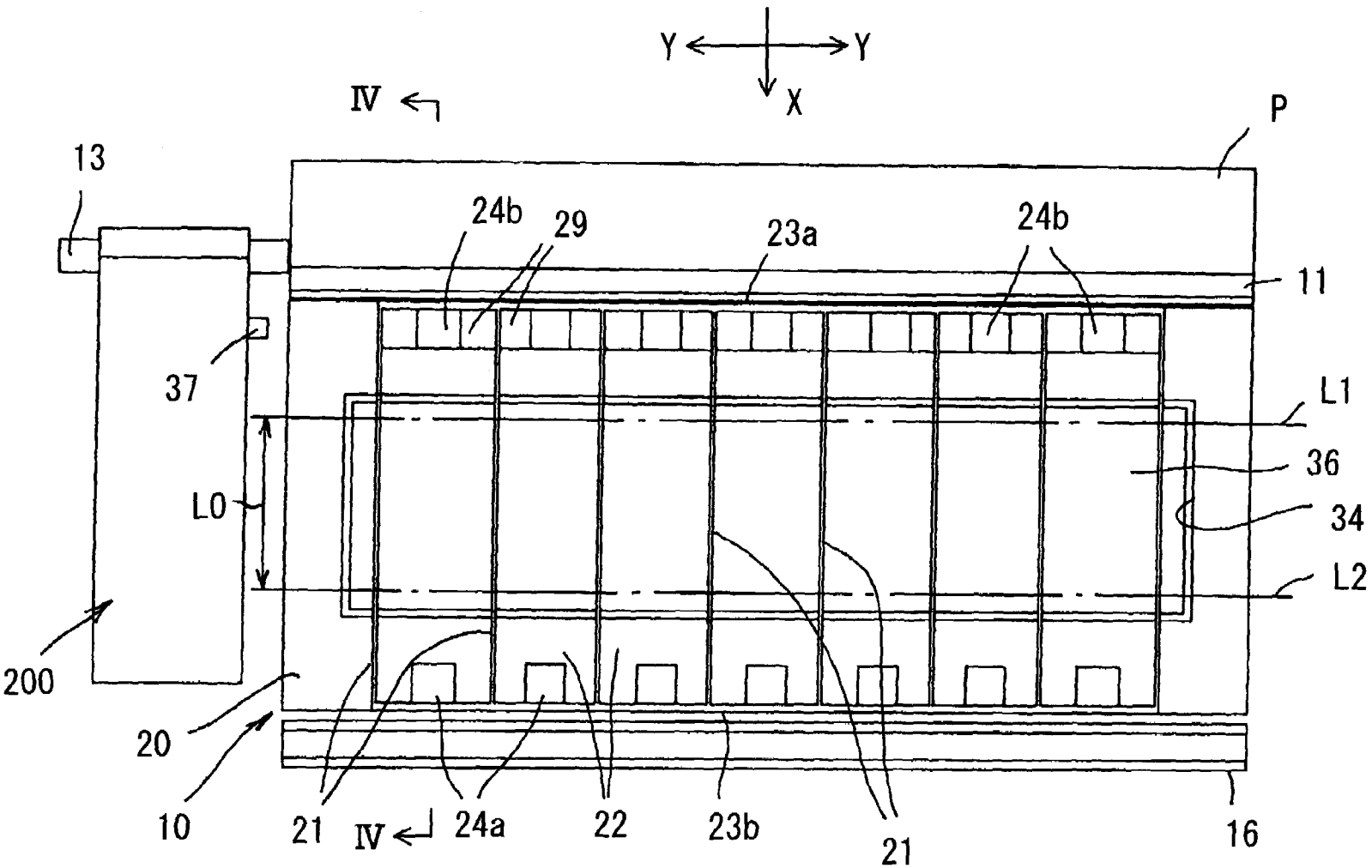
FIG. 3 is a plane view of the sheet feed table according to the invention.

As shown in FIGS. 2 and 3, rib-like upstream and downstream protrusions 23*a*, 23*b* that extend in the direction Y, so as to connect upstream and downstream ends of all ribs 21, respectively, are provided on the upper surface of the upper plate 20, outside the image forming region. With this structure, the air ducts 22 are independently defined by the ribs 21, the protrusions 23*a*, 23*b*, the ink absorber 36, and the upper surface of the upper plate 20. Therefore, such current of air that crosses over the ribs 21 is prevented.

Formed on the upper surface of the upper plate 20, at downstream and upstream sides of the image forming region in the sheet feeding direction, are a downstream suction opening 24*a* and an upstream suction opening 24*b* that allow the air to be sucked therethrough. The upstream suction opening 24*b* is formed in a stepped-down portion 29 formed upstream of the image forming region. The suction openings 24*a*, 24*b* are connected to a negative pressure chamber 25 provided in the sheet feed table 10, as shown in FIGS. 1 and 4. The side plates 35*a* and the bottom plate 35*b* connected thereto are structured as a wall that separates the negative pressure chamber 25 from the ink receiving chamber 35. In other words, the wall is shared by the negative pressure chamber 25 and the ink receiving chamber 35. Therefore, the negative pressure chamber 25 and the ink receiving chamber 35 are separated, with a simple structure, by the wall.

The negative pressure chamber 25 is connected to a suction device 26, as shown in FIG. 1, that includes a suction fan and a discharge pump. As the suction device 26 is operated, the air is sucked through the downstream and upstream suction openings 24*a*, 24*b* substantially at the same time. As described above, the negative pressure chamber 25 and the ink receiving chamber 35 are separated or partitioned, and the ink receiving chamber 35 is not affected by a suction force applied by the suction device 26.

The carriage 200 is provided with a detector that detects right and left edges of the sheet P in the direction Y, to determine the width of the sheet P. In this embodiment, an optical sensor 37 is mounted on an upstream side surface of the carriage 200 to face downwardly toward the sheet feed table 10. The optical sensor 37 includes a photo-transmitter that applies the light to a portion of the upper surface of the upper plate 20 extending in the direction Y and where the stepped-down portions 29 and the upstream suction openings 24*b* are formed, and a photo-receiver that receives the reflected light.

Operations of the printer 1 structured as described above will be described. When an image forming or printing command is issued by operation of the keys provided on the control panel (not shown), the optical sensor 37 is activated and the carriage 200 is moved in the main scanning direction Y. While the optical sensor 37 irradiates light over the portion where the stepped-down portions 29 and the upstream suction openings 24*b* are formed, the optical sensor 37 detects areas where the sheet P is not placed on the sheet feed table 10, based on the condition that an amount of the light reflected off the stepped-down portions 29 and the upstream suction openings 24*b* is smaller. Thus, the width of the sheet P is determined. Thereafter, based on the detected sheet width, the carriage 200 is stopped, for a flushing operation, at a position outside the sheet width and at a sufficient distance from a side edge of the sheet P to prevent the sheet P from being contaminated by the ink ejected during the flushing operation. The position where the carriage 200 is stopped is above the ink passage openings 34, where the ribs 21 are not formed. Then, the flushing operation is performed by driving the print head 2 to eject ink from all the nozzles toward the ink passage openings 34. Thus, the ink ejecting performances of the nozzles are recovered by clearing the ink clogged in the nozzles or removing the air in the ink. The ink ejected to the ink passage openings 34 is held in the ink absorber 36 in the ink receiving chamber 35.

Thereafter, the topmost sheet P on the sheet tray 5 is picked up by the pick-up roller 6 and fed to the sheet feeding path 7, as the suction device 26 is operated. The sheet P is held between the sheet conveying rollers 9*a*, 9*b* and further fed to the upstream sheet feeding rollers 11, 12. Then, the leading end of the sheet P is held at a nip portion between the upstream driven and drive rollers 11, 12. The upstream drive roller 12 and downstream drive roller 16 are intermittently driven in synchronization with each other. As the sheet P is fed near the upstream of the image forming region on the sheet feed table 10, the leading end of the sheet P is sucked to contact the upper edges of the ribs 21, by negative pressure applied due to a current of air flowing into the upstream suction opening 24*b* through the air duct 22. The sheet P is further fed in the sheet feeding direction X, with the sheet P contacting and sliding over the upper edges of the plurality of ribs 21.

As the leading end of the sheet P enters the image forming region and is further fed in the sheet feeding direction X, negative pressure is further applied to the sheet P, due to a current of air flowing into the downstream suction opening 24*a*, as well as the upstream suction opening 24*b*. Therefore, the sheet P being fed over the plurality of the ribs 21 is held substantially parallel to the upper surfaces of the ribs 21. Therefore, even when the distance between the nozzle surface 2*a* of the print head 2 and the upper surface of each rib 21 is short, the sheet P will not contact the nozzle surface 2*a*, thereby preventing the sheet P from being smudged.

The ink passage openings 34 are provided within the image forming region on the bottom plate 22*a* away from the upper edges of the ribs 21. In addition, the ink receiving chamber 35 and the negative pressure chamber 25 are partitioned, so that the negative pressure in the negative pressure chamber 25 does not affect the ink passage openings 34. Therefore, the leading end of the sheet P passing over the upper edges of the ribs 21 does not contact an upper surface of the ink absorber 36 disposed in the ink receiving chamber 35. Accordingly, the rear side of the sheet P is not smudged with ink.

During the printing operation in which sheet feeding and ink ejection are performed, a sealed space is formed along the sheet feeding direction X between the sheet P passing over the upper surfaces of the ribs 21 and each of the air ducts 22. The sealed space (air duct 22) is connected to the downstream and upstream suction openings 24*a*, 24*b*. As the suction device 26 is operated, great negative pressures occur in the sealed spaces of the air ducts 22, so that the sheet P, passing over the sheet feed table 10, does not lift while the ink is ejected on the sheet P or the sheet P is fed intermittently little by little in the sheet feeding direction X during the printing operation. Thus, the sheet P is held substantially flat on the sheet feed table 10.

In this embodiment, the sheet P is fed while being supported by the ribs 21 with the narrow width so that a contact portion between the sheet P and the sheet feed table 10 can be reduced. Consequently, the sheet P is fed with a lighter force by reducing frictional loads applied during sheet feeding at the contact portion between the sheet P and the sheet feed table 10, as compared with the case where the sheet feed table 10 does not have the air ducts 22 and the sheet P is fed with a surface thereof being in sliding contact with the surface of the sheet feed table 10.

Since the air is sucked during the printing operation, it is easier for the print head 2 to dry, as compared with a print head of a printer that does not employ a system to suck the sheets P. Accordingly, the flushing operation has to be performed more often. However, the printer 1 according to the embodiments can perform the flushing operation at a position beside a side edge of the sheet P in the sheet feed table 10. Therefore, the distance that the carriage 200 has to move for the execution of the flushing operation is reduced, and consequently, the time required for the flushing operation can be reduced. As the flushing operation is performed in a shorter time, the printing operation efficiency is increased. In addition, the air is sucked during the printing operation. Therefore, even when some ink is spattered during the flushing operation, the ink is sucked along with the air, so that the ink does not adversely affect the print quality.

To form an image on the sheet P, ink is ejected on a predetermined portion of the sheet P from the nozzles of the print head 2 mounted on the carriage 200 moving in the main scanning direction Y. Thereafter, the sheet P is fed in the sub scanning direction X by a predetermined amount. Operations of the ink ejection and sheet feeding are repeatedly performed to form an image on the sheet P. During the printing operation, distance between the sheet P and the nozzle surface 2*a* of the print head 2 is maintained constant.

As the trailing end of the sheet P passes through the upstream sheet feeding rollers 11, 12 and moves downstream of the upstream suction portions 24*b*, the negative pressure is reduced at the upstream suction openings 24*b*, because the sealed space is no longer created at the upstream suction openings 24*b* after the sheet P passes over the suction openings 24*b*. However, the negative pressure is maintained at the downstream suction openings 24*a*, due to a current of air flowing into the suction openings 24*a* provided on the downstream side of the air ducts 22. Therefore, the trailing end of the sheet P is sucked to contact the upper edges of the ribs 21.

Even when the trailing end of the sheet P tends to curl or turn up, the sheet P is maintained substantially parallel to the upper surfaces of the ribs 21. Therefore, the sheet P is prevented from contacting the nozzle surface 2*a* of the print head 2, so that the sheet P is not smudged with ink. The suction openings 24*a*, 24*b* are formed on the downstream and upstream sides of the image forming region. Therefore, the sheet P is fed with the leading end thereof sucked, due to the upstream suction opening 24*b*, toward the upper edges of the ribs 21 before entering the image forming region. The sheet P is fed with the trailing end of the sheet P sucked, due to the downstream suction opening 24*a*, toward the upper edges of the ribs 21 before leaving from the image forming region toward the downstream side in the sheet feeding direction X. With this structure, the sheet P is prevented from contacting the nozzle surface 2*a* of the print head 2, so that deterioration of image quality can be prevented.

As shown in FIG. 1, a spur roller 38 that restricts the sheet lifting is rotatably supported on a shaft (not shown) above the sheet feed table 10 between the downstream sheet feeding rollers 15, 16 and a cut-off portion 200*b* formed on the downstream lower surface of the carriage 200 in the sheet feeding direction X. With the spur roller 38, the surface of the sheet P moist with the ink does not slide over a lower surface of the print head 2.

The flushing operation can be performed before the start of the printing operation, as well as in the middle of the printing operation to form an image onto one sheet P. Further, the flushing operation can performed after the printing operation is started but before the leading end of the sheet P reaches the image forming region, or at the end of feeding one sheet P, such as when the printing operation is performed for a plurality of the sheets P. In this case, the flushing operation is performed when the trailing end of one sheet P and the leading end of the subsequent sheet P are not above the ink passage openings 34. When the sheet P is not passing over the ink passage openings 34, the flushing operation can be performed at any position above the ink passage openings 34 aligned in the main scanning direction Y, by moving or unmoving the print head 2. If the flushing operation is performed with the print head 2 moved, the flushing operation may be performed while the print head 2 is moved from the current position of the carriage 200 to a predetermined print starting position. With such structures, the distance that the carriage 200 moves in the main scanning direction X for the flushing operation is reduced, as compared with a known printer having a maintenance unit, where the flushing operation is performed, in an area outside the sheet feed table 10. Consequently, the prompt printing operation is achieved.

In this embodiment, the ink ejected during the flushing operation is received by the ink receiving chamber 35, through the ink passage openings 34 provided on the surface of the sheet feed table 10 at a portion that faces the nozzle surface 2*a*, and the moving distance of the carriage 200 is reduced. Therefore, the physical size of the printer 1 can be reduced in the width direction of the printer 1 and prompt image formation can be achieved. With this structure, an increase in the number of components for the provision of a maintenance unit and its supporting member, as well as complicated structures attributable thereto can be prevented. Further, an increase in costs can also be prevented.

Figure 5:
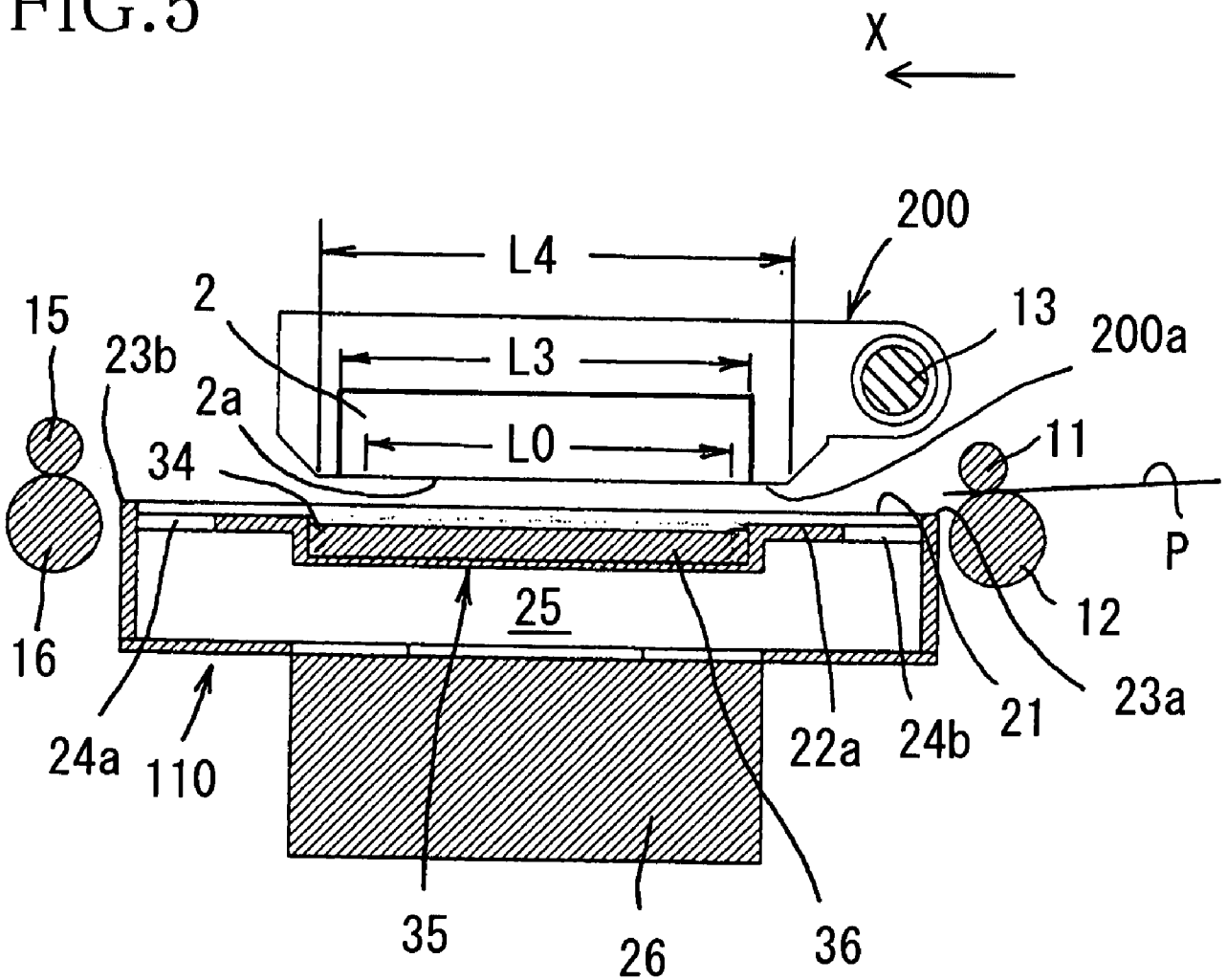
FIG. 5 is a cross-sectional view of the sheet feed table according to the invention.

A sheet feed table 110 according to a modification of the first embodiment of the invention will be described with reference to FIG. 5. It should be noted that like numerals represent like components. FIG. 5 shows a cross section of the sheet feed table 110, taken along the sheet feeding direction X, similar to FIG. 4. The sheet feed table 110 is substantially the same as the sheet feed table 10 according to the first embodiment, except that the upstream suction opening 24*b* is formed on the bottom plate 22*a* of the air ducts 22, without providing the stepped-down portions 29. In the sheet feed table 110, a strip of an area on the surface of the bottom plate 22*a* where the upstream suction openings 24*b* are aligned in the direction Y, is textured to effectively reflect light diffusely applied by the optical sensor 37.

Accordingly, similar to the above-described first embodiment, the amount of light reflected off the textured area and the suction openings 24*b* that are not covered by the sheet P, is smaller. Thus, the detection of the right and left side edges of the sheet P can be reliably made by the sensor 37. The surface of the bottom plate 22*a* (upper plate 20) may be entirely textured.

Figure 6:
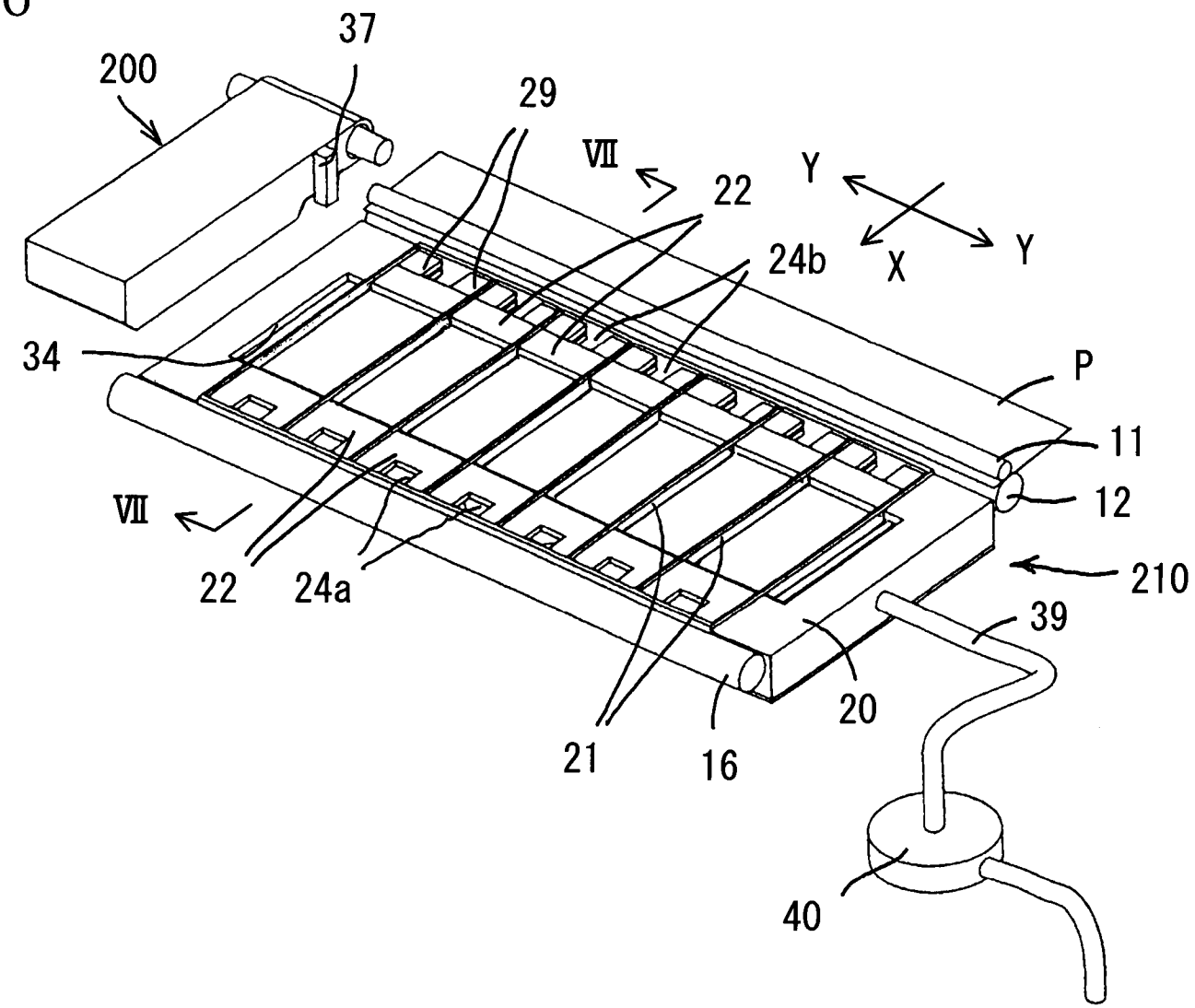
FIG. 6 is a perspective view of a sheet feed table according to the invention.
Figure 7:
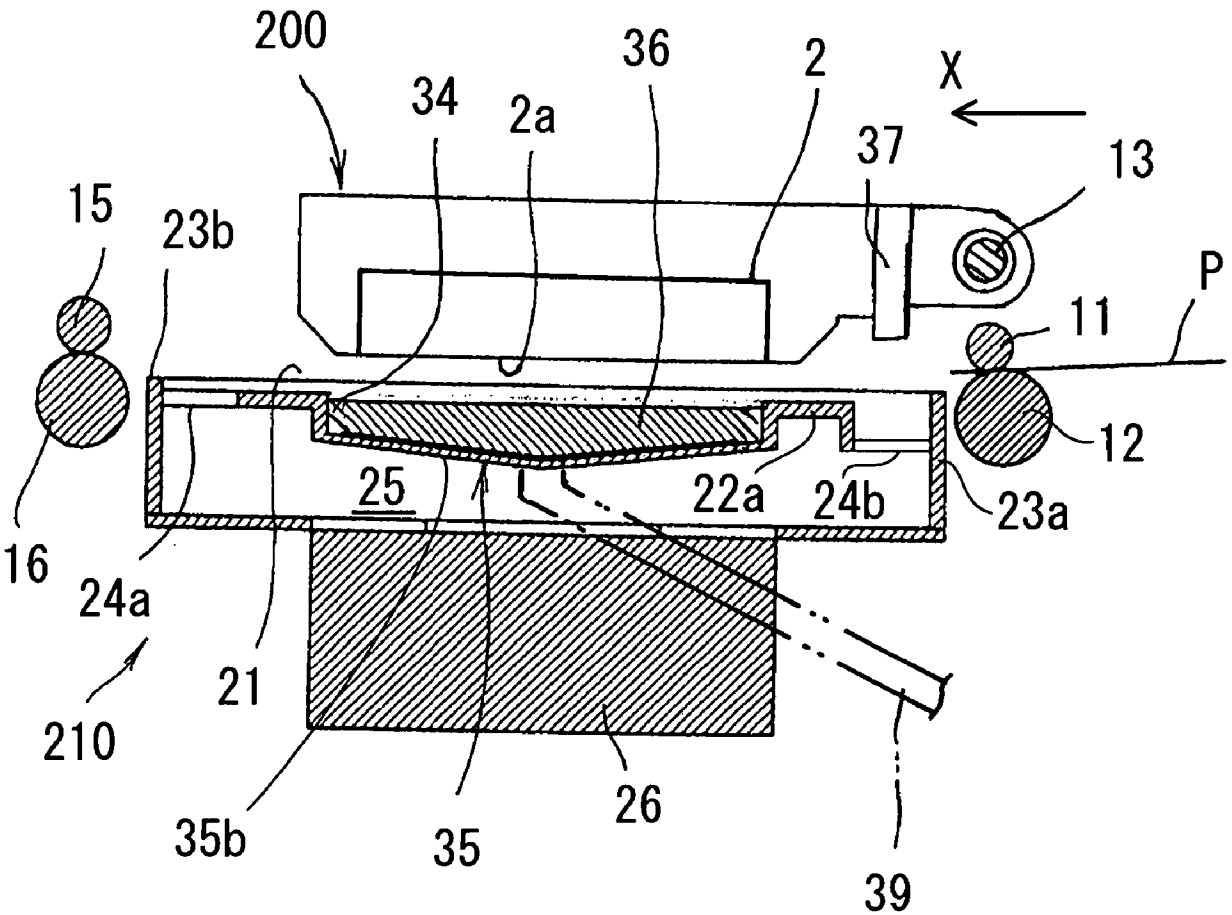
FIG. 7 is a cross-sectional view of the sheet feed table according to the invention, taken along VII—VII in FIG. 6.

Another sheet feed table 210 according to a second embodiment of the invention will be described below with reference to FIGS. 6 and 7. As shown in FIG. 7, the ink receiving chamber 35 is provided such that a substantially central portion of the bottom plate 35*b* in the sheet feeding direction X is deepened. With this structure, the ink accumulated at a bottom of the ink absorber 36 is prevented from coming out through the ink passage openings 34. An ink discharge tube 39 is disposed such that one end thereof is connected to the bottom plate 35*b* of the ink receiving chamber 35, as shown in FIG. 7, and the other end thereof is connected to a suction mechanism 40, as shown in FIG. 6, that includes a suction pump. The suction mechanism 40 is operated to discharge the ink stored in the ink receiving chamber 35 into a waste ink reservoir (not shown) provided in or outside the printer 1, in association with the flushing operation for the print head 2, or every time the predetermined number of flushing operations is performed.

In addition to the ink discharge from the ink receiving chamber 35, the suction mechanism 40 may be shared with another mechanism of the printer 1. For example, the suction mechanism 40 may be connected to a purge mechanism provided for the printer 1 outside the sheet feed table 10, through a switching mechanism that makes a switch between the ink discharge operation in which ink in the ink receiving chamber 35 is discharged therefrom, and a purge operation in which the nozzle surface 2*a* of the print head 2 is covered by a cap to suck ink in the print head 2 from the cap side by the application of negative pressure with the purge mechanism.

In the first and second embodiments, as well as the modification of the first embodiment, the suction device 26 is disposed in a substantially central portion of the sheet feed table 10 in the main scanning direction Y in plan view. Therefore, the sheet P can be stably sucked across the sheet width direction, with a suction force applied by the suction device 26 through the plurality of the suction openings 24*a*, 24*b* aligned in the main scanning direction Y.

Figure 8:
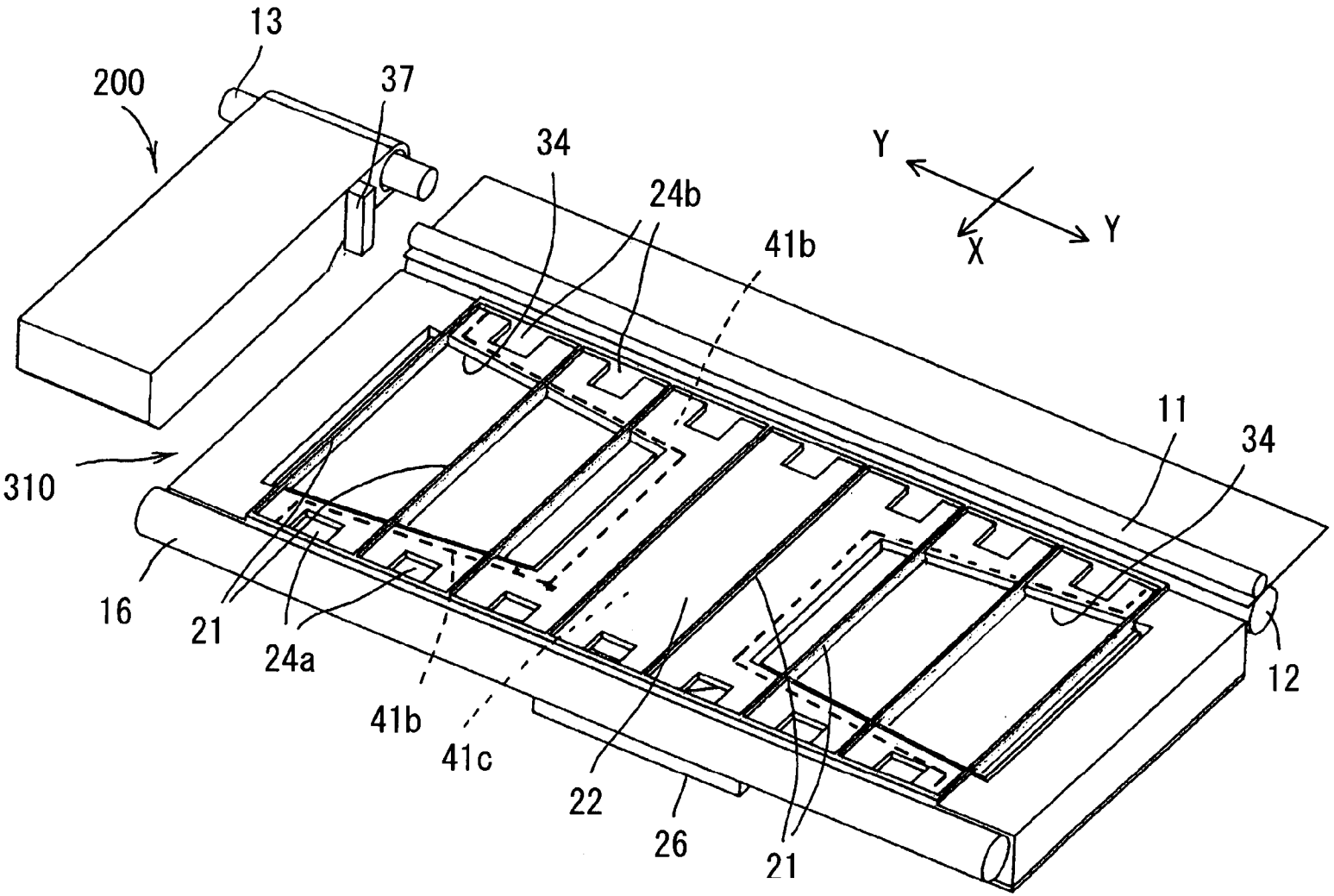
FIG. 8 is a perspective view of a sheet feed table according to the invention.
Figure 9:
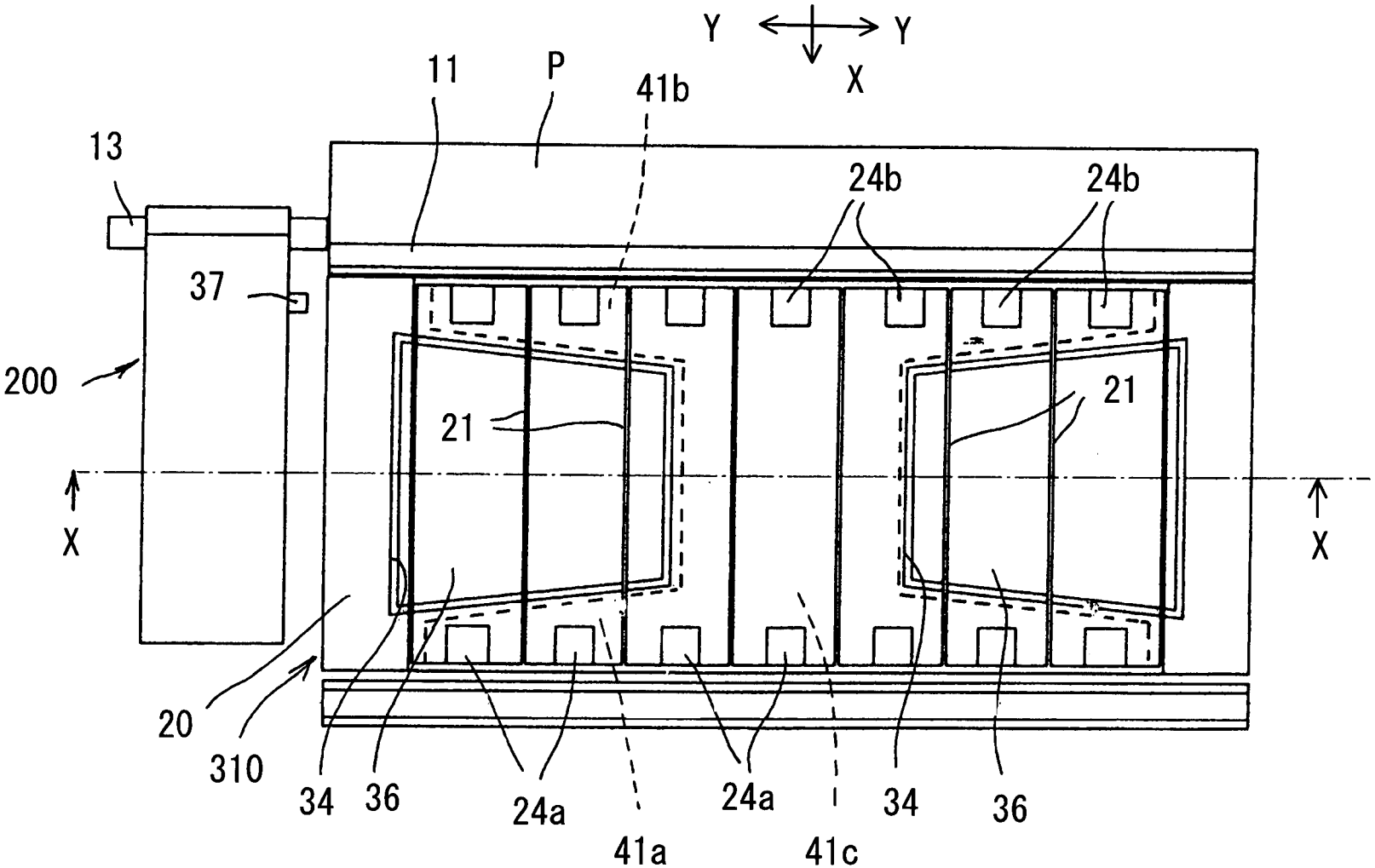
FIG. 9 is a plane view of the sheet feed table according to the invention.
Figure 10:
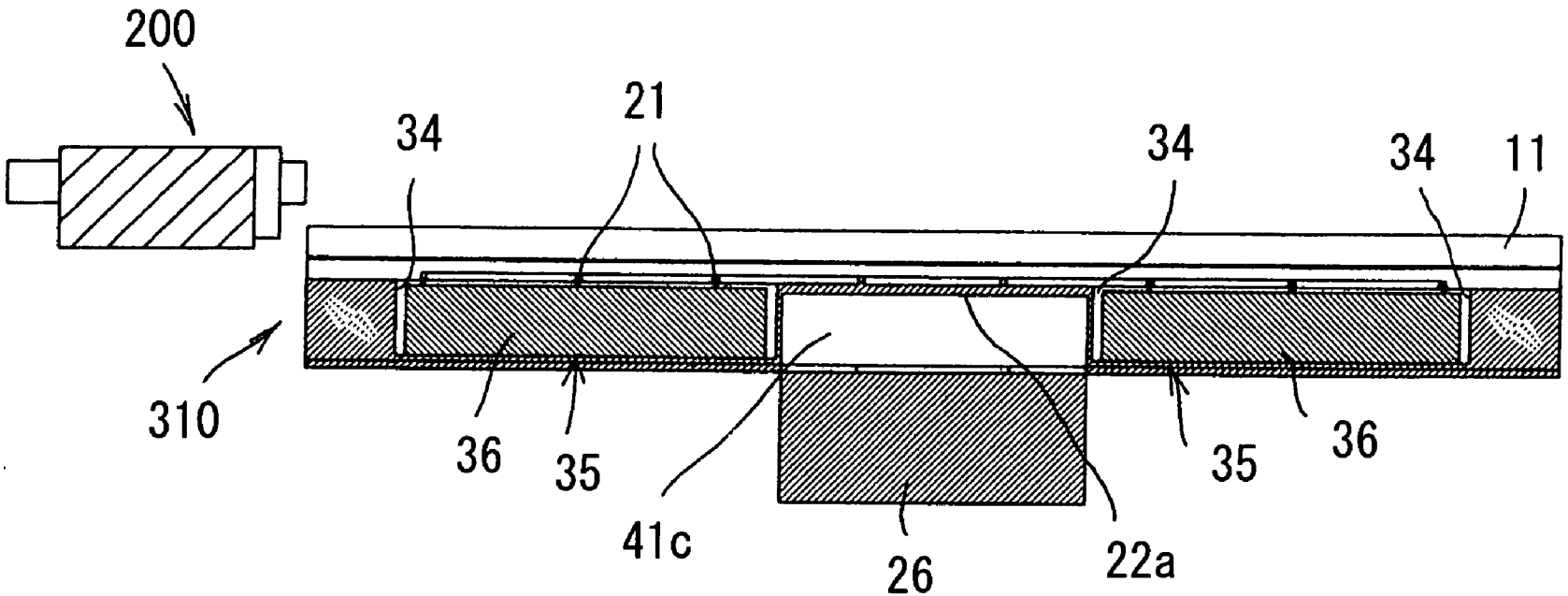
FIG. 10 is a cross-sectional view of the sheet feed table according to the invention, taken along X—X in FIG. 9.

A sheet feed table 310 according to a third embodiment of the invention will be described below, with reference to FIGS. 8–10. An ink receiver of the ink passage openings 34 and ink receiving chamber 35 are separately formed in the sheet feed table 310 on the right and left sides thereof in the direction Y, except for a central portion. The bottom of the ink receiving chamber 35 is formed to reach the bottom plate 10*a* of the sheet feed table 310, as will be best seen in FIG. 10. The suction openings 24*b*, 24*a* are respectively disposed upstream and downstream of the image forming region on the upper plate 20, similar to the modification of the first embodiment. To lead the air to the suction device 26 through the suction openings 24*a*, 24*b*, an upstream air duct 41*b* that communicates with all upstream suction openings 24*b* and a downstream air duct 41*a* that communicates with all downstream suction openings 24*a* are formed upstream and downstream of the image forming region, respectively, in an inner space of the sheet feed table 310, so as to extend in the direction Y. A central air duct 41*c* that communicates with the upstream and downstream air ducts 41*b*, 41*a* is formed in an inner space of the sheet feed table 310 at a position corresponding to a portion between the right and left ink passage openings 34. The suction device 26 is disposed below a substantially central portion of the sheet feed table 310 in the direction Y in plan view, to establish communication between the central air duct 41*c* and the suction device 26. In the third embodiment, the downstream and upstream air ducts 41*a*, 41*b* and the central air duct 41*c* form the negative pressure chamber 25 according to the first embodiment.

The ink passage opening 34 and ink receiving chamber 35 disposed on the left and right sides of the sheet feed table 310 is of a substantially trapezoidal shape in plan view, to gradually narrow the ink passage opening 34 and the ink receiving chamber 35 down toward the central portion of the sheet feed table 310 in the direction Y. Correspondingly, a cross-sectional area of each of the downstream and upstream air ducts 41*a*, 41*b*, taken along the sheet feeding direction X, becomes wider toward the central portion of the sheet feed table 310, as shown in FIGS. 8 and 9. In other words, the width of the downstream and upstream air ducts 41*a*, 41*b* in the sheet feeding direction X becomes smaller from the central portion of the sheet feed table 310 toward the right or left end thereof. Consequently, the cross-sectional area of each downstream and upstream air duct 41*a*, 41*b* becomes smaller at the right and left ends in FIGS. 8 and 9. Because the cross-sectional areas of the air ducts 41*a*, 41*b* become wider toward the central portion to which the air is led, the air is sucked readily. The air ducts 41*a*, 41*b*, 41*c* can be divided, with a simple structure, by the four side plates 35*a* and the bottom plate 35*b* of the ink receiving chamber 35.

With the above-described structure, the air is sucked through all the suction openings 24*a*, 24*b* substantially at the same time with one suction device 26. Each of the air ducts 41*a*, 41*b* are formed such that a cross-sectional area thereof becomes narrower toward the right or left end of the sheet feed table 310 from the central portion thereof in the direction Y, unlike the ink passage opening 34 and the ink receiving chamber 35 that become wider toward the right or left end of the sheet feed table 310 from the central portion thereof. Therefore, suctioning of the sheet P is stably performed in each suction opening 24*a*, 24*b*, while reducing variances in negative pressures applied.

Further, the bottom of the ink receiving chamber 35 is formed substantially flush with the bottom plate 10*a* of the sheet feed table 310 according to the third embodiment. With this structure, the thickness of the sheet feed table 310 is reduced while an ink storage capacity of the ink receiving chamber 35 is increased.

Figure 11:
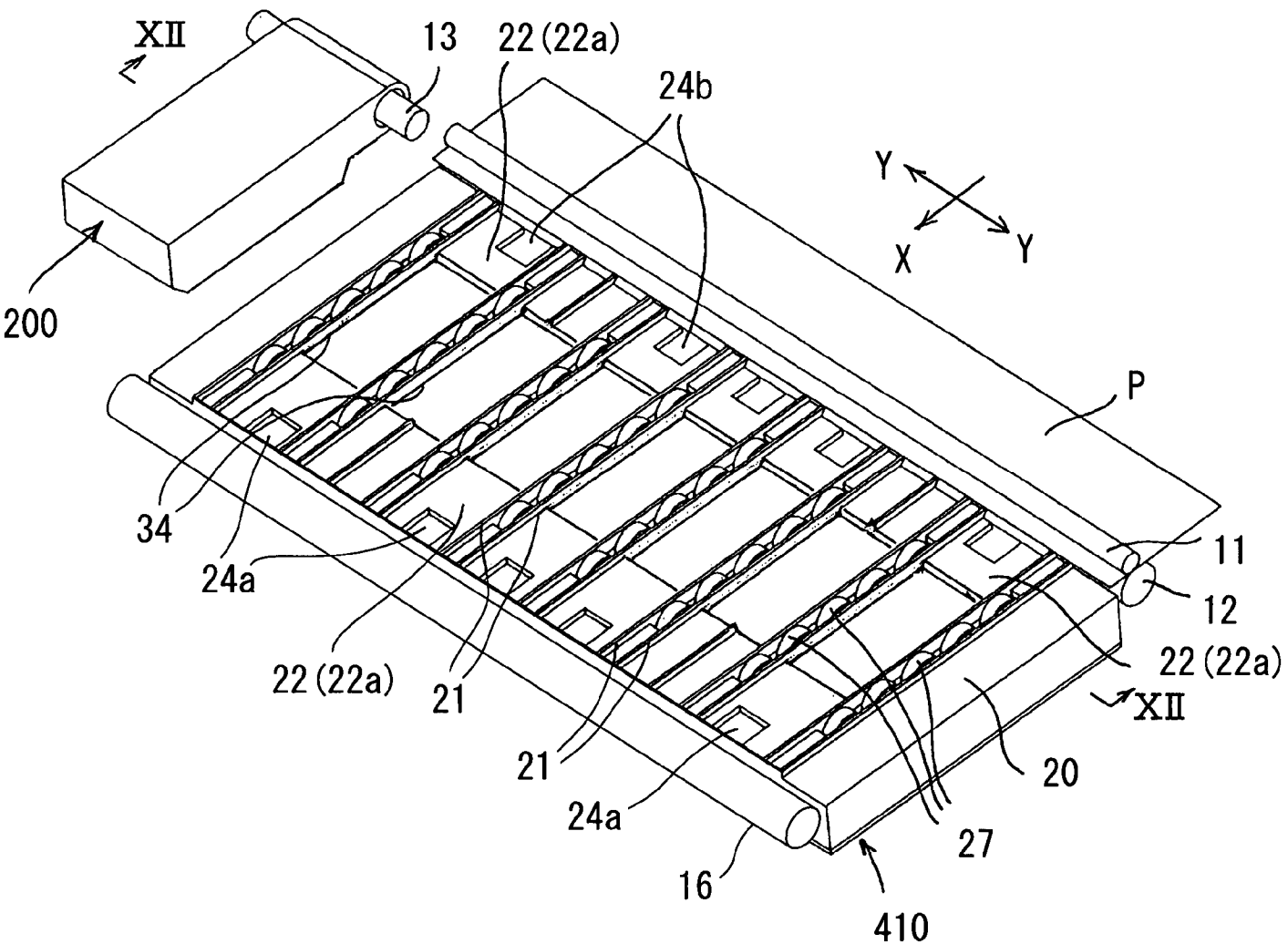
FIG. 11 is a perspective view of a sheet feed table according to the invention.
Figure 12:
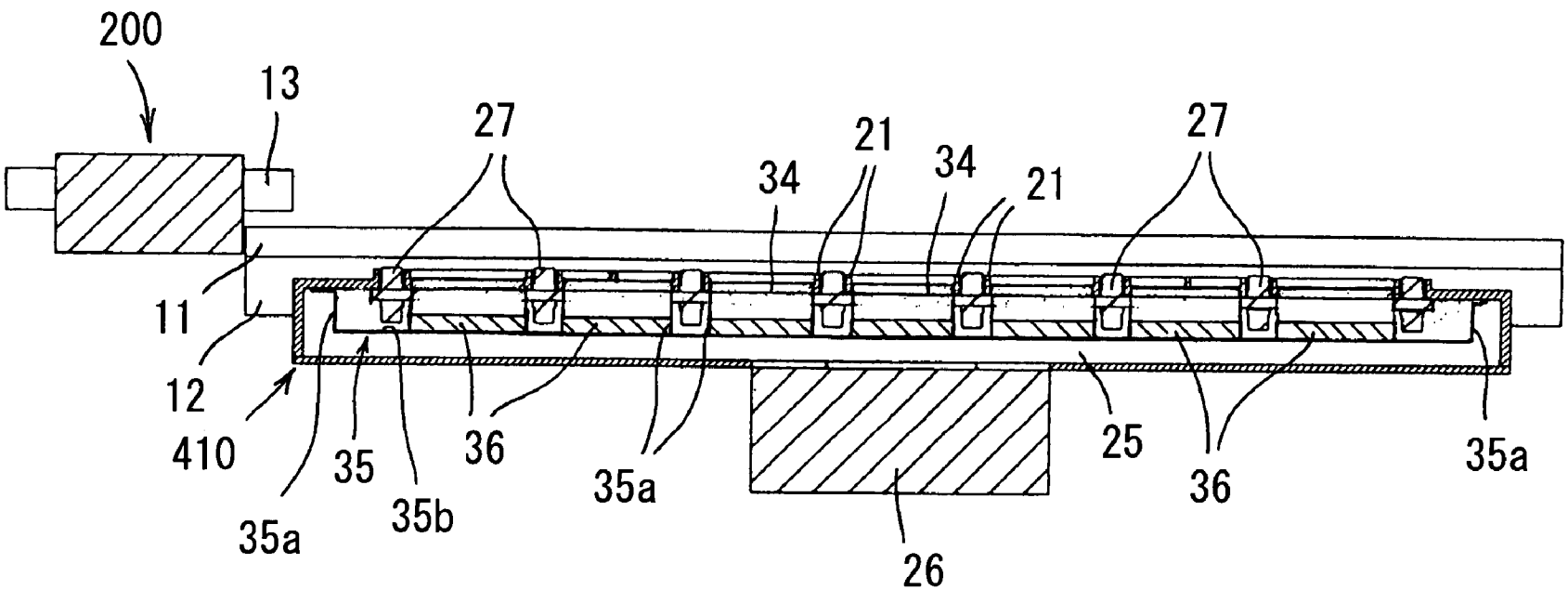
FIG. 12 is a cross-sectional view of the sheet feed table according to the invention, taken along XII—XII in FIG. 11.

A sheet feed table 410 according to a fourth embodiment of the invention will be described below with reference to FIGS. 11 and 12. The sheet feed table 420 is provided on the upper plate 20 with pairs of ribs 21. Each pair of ribs 21 is disposed at a certain distance between the ribs 21 in which a plurality of rollers 27 are disposed, to rotate in the sheet feeding direction X, along the sheet feeding direction X at a pitch of, for example, about 10 mm to 30 mm. Each roller 27 is rotatably supported by a shaft (not shown). The width of each roller 27 is set to preferably about 0.5 mm to 10 mm and the radius to about 4.3 mm to 20 mm.

A part of a circumferential surface of the roller 27 protrudes upwardly from the upper edge of the ribs 21 by a predetermined amount of, for example, about 0.1 mm to 0.4 mm. In the fourth embodiment, an upper surface of each of the pair of the ribs 21 may have a plurality of substantially rectangular recesses in plan view formed at a predetermined interval, to expose a part of a circumferential surface of the roller 27 from the upper surface of the rib 21. Alternatively, an upper surface of each of the pair of the ribs 21 may have one long recess elongated in the sheet feeding direction X to expose parts of circumferential surfaces of the rollers 27.

The suction openings 24*a*, 24*b* are formed on the bottom plate 22*a* of the air ducts 22 divided by the ribs 21 on the downstream and upstream sides of the image forming region in the sheet feeding direction X, outside the image forming region. The suction openings 24*a*, 24*b* are connected to the negative pressure chamber 25, as shown in FIG. 12, that is formed below the upper plate 20 of the sheet feed table 410. The negative pressure 25 is connected to the suction device 26, as shown in FIG. 12, that includes a suction fan and a discharge pump. As the suction device 26 is operated, the air is sucked through the downstream and upstream suction openings 24*a*, 24*b* substantially at the same time.

In the fourth embodiment, the ink passage openings 34 are formed on the upper plate 20 of the sheet feed table 410 within the image forming region. The upwardly-open ink receiving chamber 35 is disposed to cover an underside of the ink passage openings 34. Similar to the above-described embodiments, the ink absorber 36 that is formed of, for example, spongy or porous material is disposed in the chamber 35. The ink receiving chamber 35 functions as a cover that covers the lower surfaces of the rows of the rollers 27, and as a wall that separates from or partitions off the negative pressure chamber 25. With this structure, the negative pressure chamber 25 and the space between the ribs 21 and the rollers 27 do not communicate with each other. Therefore, when the suction device 26 is operated, the air is sucked through the suction openings 24*a*, 24*b* and not through the space between the ribs 21 and the rollers 27.

In the fourth embodiment, the sheet P that is fed in the sheet feeding direction X first contacts the front or upstream side of the periphery of the rollers 27 protruding upwardly, and then fed over the rollers 27. As the leading end of the sheet P enters the image forming region and is further fed in the sheet feeding direction X, the negative pressures applied to a small space between the upper peripheral surfaces of the rollers 27 and the upper edges of the ribs 21, is relatively great. Therefore, the sheet P fed on the plurality of the rollers 27 is maintained substantially parallel to the upper edges of the ribs 21. Even when distance between the nozzles surface 2*a* of the print head 2 and the upper peripheral surface of each roller 27 is short, the sheet P will not slide over the nozzle surface 2*a*, so that the sheet P is not smudged with ink.

The sheet P fed over the plurality of the rollers 27 and each air duct 22 form, during the printing operation, a sealed air passage that extends in the sheet feeding direction X. The air passage (air ducts 22) communicates with the suction openings 24*a*, 24*b* formed downstream and upstream of the image forming region, respectively. As the suction device 26 is operated during the printing operation, the negative pressure occurs in the air ducts 22. Therefore, when the sheet P is intermittently fed in the sheet feeding direction X, the sheet P does not lift off the sheet feed table 410. Even when the sheet P is sucked, the sheet P is placed on the upper peripheral surface of the rotatable rollers 27, so that the sheet P is substantially kept flat on the rollers 27 and fed with a light force.

In the above-described embodiments and modification, the downstream and upstream suction openings 24*a*, 24*b* are structured to communicate with each other. Therefore, the air is sucked through the downstream and upstream suction openings 24*a*, 24*b* substantially at the same time with one suction device 26. Thus, the physical size of the sheet feed table can be reduced.

When the total areas of the downstream suction openings 24*a* and the upstream suction openings 24*b* are set equally, the suction forces applied thereto can be set to be substantially equal. Thus, the sheet P can be properly fed in the sheet feeding direction X.

In the above-described embodiments, the ink passage openings 34 and ink receiving chamber 35 do not communicate with the suction openings 24*a*, 24*b* or the negative pressure chamber 25. Therefore, when the air is continuously sucked during the printing operation, the ink passage openings 34 and ink receiving chamber 35 are not adversely affected by a current of air due to the air suctioning with the suction device 26. Accordingly, the printer 1 can form an image speedily while performing the flushing and printing operations alternatively.

As shown in FIGS. 4 and 5, the length L3 of the nozzle surface 2*a*, in the sheet feeding direction X, having the nozzle rows formed on the nozzle surface 2*a*, is longer than the nozzle row length L0. As shown in FIG. 5, the length L4 of the print head 2 or the carriage 200 mounting the print head 2 thereon, in the sheet feeding direction X is longer than the nozzle surface length L3, which is longer than the nozzle row length L0. The area scanned by the carriage 200 mounting thereon the print head 2 is wider than the width of the image forming region in the sheet feeding direction X.

Generally, the nozzle surface 2*a* of the print head 2 and the upper plate 20 of the sheet feed table is disposed with the very short distance of approximately 0.5 mm to 2.0 mm therebetween. If the suction openings 24*a*, 24*b* are formed on the upper plate 20 within the image forming region where the nozzle surface 2*a* faces, a current of air that occurs around the suction openings 24*a*, 24*b* causes a current of air around the print head 2 disposed in a short distance from the suction openings 24*a*, 24*b*. A current of air around the print head 2 causes ink in the nozzles to dry, dust to be attached to the nozzle surface 2*a*, or the ink droplets to impinge against the sheet P with a poor pitch accuracy, which adversely affects the print quality. Therefore, in the above-described embodiments and modification, the suction openings 24*a*, 24*b* are formed downstream and upstream of the image forming region on the upper plate 20, at a position outside the image forming region and at a sufficient distance from the nozzle surface 2*a* of the print head 2.

In the above-described embodiments and modification, the downstream and upstream suction openings 24*a*, 24*b* that are formed outside the image forming region are used for the sheet suctioning. Thus, the leading or trailing end of the sheet P, that are held only by one of the pairs of the upstream sheet feeding rollers 11, 12 and downstream sheet feeding rollers 15, 16, do not contact the carriage 200 or the nozzle surface 2*a* of the print head 2 mounted on the carriage 200, because the end of the sheet P is sucked outside the image forming region, due to the suction openings 24, 24*b*. Accordingly, the sheet smudges with ink or the improper sheet feeding caused by the sheet folded or torn due to the contact to the print head 2 can be prevented.

In each embodiment and modification, a width (dimension in the direction Y) of the upper surface of the rib 21 that faces the nozzle surface 2*a* of the print head 2 may be widened, as long as the width fits within the rage of approximately 0.1 to 20 mm.

The sheet feed table may be formed into a substantially convex shape, such that a central portion of the sheet feed table in the direction Y (in the direction of sheet width) slightly curves upwardly and each end is lower the central portion, to prevent the leading or trailing end of the sheet P from turning up.

While the invention has been described with reference to the embodiments, it is to be understood that the invention is not restricted to the particular forms shown in the foregoing embodiments. Various modifications and alterations can be made thereto without departing from the scope of the invention, as set forth in the appended claims.

For example, the invention may be applied to an image forming apparatus including a print head that is mounted on a carriage and moves in a direction perpendicular to a sheet feeding direction, or an image forming apparatus including a fixed-type line print head that extends in the direction perpendicular to the sheet feeding direction to cover a width of a printable area on a sheet at one printing.

In each embodiment and modification, a lower surface 200*a* of the carriage 200 is substantially flush with the nozzle surface 2*a*, as shown in FIG. 5. The lower surface 200*a* of the carriage 200 supporting the print head 2 is preferably positioned higher than the nozzle surface 2*a*.

As shown in FIGS. 2, 3, 6, 8, 9, and 11, the downstream suction opening 24*a* and the upstream suction opening 24*b* are formed downstream and upstream of the image forming region, respectively, such that the total areas of downstream and upstream suction openings 24*a*, 24*b* are set equally to make the sheet suctioning force at the downstream and upstream sides of the image forming region equal. However, the total areas of the suction openings 24*a*, 24*b* may be set unequally, as long as the differences in the total area of the suction openings 24*a*, 24*b* do not affect the sheet feeding and printing operations.

The suction openings 24*a*, 24*b* are not necessarily disposed both upstream and downstream of the image forming region for each air duct 22. However, at least the downstream suction opening 24*a* or the upstream suction opening 24*b* may be disposed for the air duct 22. More specifically, the downstream suction opening 24*a* and the upstream suction opening 24*b* may be alternatively disposed for every other air duct 22, such that adjacent air ducts 22 have different one of the downstream suction opening 24*a* and the upstream suction opening 24*b*. Further, unless the sheet feeding and printing operations is affected, either set of the downstream suction openings 24*a* or the upstream suction openings 24*b* may be provided for the sheet feed table.

The protrusions 23*a*, 23*b* that extend continuously along the direction Y over the range of the image forming region are not necessarily required for the sheet feed table, if strong sheet suctioning force is not needed. For example, the upstream protrusion 23*a* may be continuously formed and the downstream protrusion 23*b* may be provided for every other air duct 22 so as to connect the adjacent two downstream ends of the ribs 21. In addition, the protrusions 23*a*, 23*b* may be provided out of contact with the ends of the ribs 21, with some distance between the ends of the ribs 21 and the protrusions 23*a*, 23*b*. This structure does not adversely affect the air flow, similar to the case where the protrusions 23*a*, 23*b* are connected to the ribs 21.

The positions where the protrusions 23*a*, 23*b* are disposed are not limited to ends of the upper plate 20 in the sheet feeing direction X. The protrusions 23*a*, 23*b* may be disposed closer to the image forming region, with or without the ends of the ribs 21 protruding from the protrusions 23*a*, 23*b*. Further, another pair of protrusions may be disposed to a side of the suction openings 24*a*, 24*b*, near to the image forming region, to individually form the air duct 22 defined, in association with the suction opening 24*a*, 24*b*, by the ribs 21, the protrusion 23*a*, 23*b*, another pair of the protrusions, and the upper surface of the upper plate 20.

In the above-described embodiments and modification, the ink passage opening 34 is open upwardly. However, the ink passage opening 34 may be covered with a semi-permeable membrane permeable to ink.

In the above-described third embodiment, the width of the downstream and upstream air ducts 41*a*, 41*b* in the sheet feeding direction X becomes narrower toward an end of the sheet feed table 310. However, the height of the air passages 41*a*, 41*b* may be changed to reduce the cross-sectional area of the air ducts 41*a*, 41*b*.

In the above-described embodiments and modification, there is only one suction device 26 provided for the printer 1. However, the number is not limited to one, but a plurality of the suction devices 26 and a plurality of suctioning passages connected to the plurality of the suction devices 26 may be provided for an image forming apparatus.

In each of the above-described embodiments and modification, the ink receiving chamber 35 that extends in the direction Y perpendicular to the sheet feeding direction X communicates with the plurality of the ink passage openings 34. The ink absorber 36 closely contacts the lower ends of the ribs 21. The air ducts 22 are independent from each other. These structures prevent the air from leaking out from passages other than predetermined ones during the air suctioning.

A plurality of the ink receiving chambers 35 may be formed by connecting the lower ends of the ribs 21 with the bottom plate 35*b*. In this case, the ink absorber 36 may be disposed in each of the ink receiving chambers 35. With this structure, more independent air ducts 22 are formed, so that the air leakage, during air suctioning, from other passages than the predetermined ones can be prevented more effectively. Thus, the suction force of the air suctioning effectively acts on the sheet P that is fed over the sheet feed table, leading to the favorable printing operation.

In the above-described embodiments and modification, the physical size reduction of the printer 1 and speedy flushing operation can be achieved by forming the ink passage openings 34 and the ink receiving chamber 35 in the image forming region. The ink passage openings 34 and the ink receiving chamber 35 may be additionally provided at an outside area of the sheet feed table, similar to a conventional printer or image forming apparatus.

In the above-described embodiments and modification, a substantially rectangular suction openings 24*a*, 24*b* are formed on the sheet feed table. However, a plurality of small openings or mesh may be formed on the sheet feed table as the suction opening 24*a*, 24*b*.

What is claimed is:

1. An image forming apparatus, comprising:

an image forming device that forms an image on a sheet by ejecting ink;

a sheet feed table that is disposed to face an ink ejection direction of the image forming device and has a surface region at an upper side thereof for supporting the sheet;

a sheet feeding mechanism that feeds the sheet in a sheet feeding direction;

at least one air suctioning portion that is formed on the surface region of the sheet feed table at an upstream or a downstream side of an image forming region, wherein when the image forming device forms the image, the air suctioning portion allows air to be sucked therethrough;

an air suctioning device that sucks air through the air suctioning portion; and an ink receiver that is formed on the surface region of the sheet feed table and that receives ink ejected from the image forming device, the ink receiver being disposed in a portion of the image forming region, wherein the air suctioning portion includes a downstream air suctioning portion and an upstream air suctioning portion disposed downstream of and upstream of the ink receiver in the sheet feeding direction and both the downstream air suctioning portion and the upstream air suctioning portion have a plurality of openings arranged in a direction perpendicular to the sheet feeding direction.

2. The image forming apparatus according to claim 1, wherein the ink receiver does not communicate with the air suctioning portion.

3. The image forming apparatus according to claim 1, wherein the ink receiver includes an ink passage opening that allows ink ejected from the image forming device to pass therethrough and an ink receiving chamber that receives ink passing through the ink passage opening.

4. The image forming apparatus according to claim 3, wherein the ink receiving chamber is provided with an ink absorber that absorbs ink.

5. The image forming apparatus according to claim 3, wherein the image forming device includes a carriage that reciprocate in the direction perpendicular to the sheet feeding direction, and a print head mounted on the carriage, wherein the ink passage opening extends in a carriage moving direction in the image forming region.

6. The image forming apparatus according to claim 5, wherein the ink passage opening is divided into a plurality of portions in the carriage moving direction.

7. The image forming apparatus according to claim 6, wherein the ink receiving chamber communicates with all of the plurality of portions of the ink passage opening and is provided with a single ink absorber that absorbs ink passing through the plurality of portions of the ink passage opening.

8. The image forming apparatus according to claim 6, wherein the sheet feed table is provided on the surface region thereof with a plurality of ribs that extends in the sheet feeding direction, and the ribs divides the ink passage opening into the plurality of the portions in the carriage moving direction.

9. The image forming apparatus according to claim 8, wherein each of the ribs has a lower end that extends in the ink ejection direction and the lower end enters from the ink passage opening to the ink receiving chamber to contact the ink absorber.

10. The image forming apparatus according to claim 8, wherein each end of each of the ribs in the sheet feeding direction is disposed across the ink passage opening and the surface region of the sheet feed table is substantially divided into a plurality of areas by the plurality of the ribs.

11. The image forming apparatus according to claim 10, wherein the air suctioning portion is provided with a suction opening in each of the areas divided by the ribs, on upstream and downstream sides of the image forming region across the image forming region.

12. The image forming apparatus according to claim 8, wherein a protrusion that extends in the carriage moving direction is disposed on the surface region of the sheet feed table, on upstream and downstream sides of the image forming region across the image forming region, and the ribs are connected at each end thereof in the sheet feeding direction by the protrusion.

13. The image forming apparatus according to claim 5, wherein a detector that applies light to the surface region of the sheet feed table and receives the reflected light is disposed on one of the carriage and the image forming device.

14. The image forming apparatus according to claim 13, wherein a part of the surface region of the sheet feed table where the light is applied by the detector has a stepped-down portion formed lower than the part of the surface region.

15. The image forming apparatus according to claim 8, wherein at least a pair of ribs is disposed in the surface region of the sheet feed table, a plurality of rollers are disposed along the sheet feeding direction between the pair of the ribs, and each of the rollers is supported to rotate in the sheet feeding direction.

16. The image forming apparatus according to claim 3, wherein the sheet feed table has an upper surface that faces the image forming device and a bottom surface that faces the upper surface, the upper surface is formed thereon with a supporter that supports the sheet, and the ink passage opening, and the ink receiving chamber is formed between the upper surface and the bottom surface.

17. The image forming apparatus according to claim 16, wherein an air duct that leads air to the air suctioning device through the air suctioning portion is formed between the upper surface and the bottom surface, the air duct is separated from the ink receiving chamber by a wall that connects the upper surface and the bottom surface, and the ink receiving chamber and the air duct are formed by the upper surface, the bottom surface and the wall.

18. The image forming apparatus according to claim 17, wherein the air suctioning device is formed at a substantially central portion of the sheet feed table in the direction perpendicular to the sheet feeding direction in order to communicate with the air duct.

19. The image forming apparatus according to claim 17, wherein the downstream air suctioning portion and the upstream air suctioning portion are disposed downstream of and upstream of the image forming region in the sheet feeding direction, the air duct is disposed upstream of and downstream of the image forming region, the ink receiver is disposed at each end of the sheet feed table in the direction perpendicular to the sheet feeding direction with a substantially central portion in the direction perpendicular to the sheet feeding direction sandwiched between the ink receivers and the upstream and downstream air ducts are connected with each other inside the sheet feed table by a space defined between the ink receiver disposed at the each end.

20. The image forming apparatus according to claim 17, wherein cross-sectional areas of the upstream and downstream air ducts gradually become larger toward a central portion of the sheet feed table in the direction perpendicular to the sheet feeding direction.

21. The image forming apparatus according to claim 1, wherein the air suctioning device is activated at least while the image forming device ejects ink into the ink receiver.

22. The image forming apparatus according to claim 1, further comprising an ink discharge passage through which ink is sucked from the ink receiver.

23. The image forming apparatus according to claim 1, wherein the image forming device is controlled to perform a flushing operation at the image forming region.

24. The image forming apparatus according to claim 1, wherein the air suctioning device sucks air to prevent the sheet from turning up.

25. A sheet feed table for use in an image forming apparatus including an image forming device, comprising:

an air suctioning portion that allows air to be sucked therethrough and is formed on a surface region of the sheet feed table on at least one of an upstream or a downstream side of an image forming region where the image forming device forms the image, the surface region being disposed to face the image forming device;

an air suctioning device that sucks air through the air suctioning portion; and an ink receiver that is formed on the surface region of the sheet feed table and that receives ink ejected from the image forming device, the ink receiver being disposed in a portion of the image forming region, wherein the air suctioning portion includes a downstream air suctioning portion and an upstream air suctioning portion disposed downstream of and upstream of the ink receiver in a sheet feeding direction and both the downstream air suctioning portion and the upstream air suctioning portion have a plurality of openings arranged in a direction perpendicular to the sheet feeding direction.

* * * * *